US007941943B2

(12) United States Patent
Baker et al.

(10) Patent No.: US 7,941,943 B2
(45) Date of Patent: May 17, 2011

(54) BALL CONTROL INSERT

(75) Inventors: Brian D. Baker, Portland, OR (US); Alexandre Baudouin, Portland, OR (US); John A. Droege, Portland, OR (US); Erez Morag, Lake Oswego, OR (US); Morgan Stauffer, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 839 days.

(21) Appl. No.: 11/876,190

(22) Filed: Oct. 22, 2007

(65) Prior Publication Data

US 2009/0100712 A1 Apr. 23, 2009

(51) Int. Cl.
*A43B 23/26* (2006.01)
*A43C 11/00* (2006.01)

(52) U.S. Cl. ..... 36/54; 36/133; 36/50.1

(58) Field of Classification Search ..... 36/54, 133, 36/136, 45, 50.1
See application file for complete search history.

(56) References Cited

U.S. PATENT DOCUMENTS

| | | | | |
|---|---|---|---|---|
| 155,968 | A | 10/1874 | Owens | |
| 973,657 | A | 7/1911 | Drake | |
| 3,525,165 | A | 8/1970 | Randall, Jr. | |
| 3,858,337 | A | 1/1975 | Vogel | |
| 4,132,016 | A | 1/1979 | Vaccari | |
| 5,367,791 | A | 11/1994 | Gross et al. | |
| 5,528,841 | A | 6/1996 | Pozzobon | |
| 5,737,858 | A | 4/1998 | Levy | |
| 5,897,446 | A | 4/1999 | Wiseman et al. | |
| 6,023,859 | A | 2/2000 | Burke et al. | |
| 6,038,792 | A | 3/2000 | Hauter | |
| 6,681,503 | B2 * | 1/2004 | Morle | 36/99 |
| 7,140,129 | B2 | 11/2006 | Newson et al. | |
| 7,331,128 | B1 | 2/2008 | Navasky et al. | |
| 2002/0029496 | A1 | 3/2002 | Morle | |
| 2005/0022430 | A1 | 2/2005 | Terry | |
| 2005/0144812 | A1 | 7/2005 | Wheeler | |

FOREIGN PATENT DOCUMENTS

| | | |
|---|---|---|
| EP | 0029794 | 6/1981 |
| EP | 0496931 | 8/1992 |
| EP | 1430800 | 6/2004 |
| FR | 1319937 | 3/1963 |
| JP | 9140402 | 6/1997 |
| WO | WO 96/32856 | 10/1996 |

OTHER PUBLICATIONS

Chinese Office Action, dated Oct. 16, 2009, from Chinese Application No. 200810247096.6.

* cited by examiner

*Primary Examiner* — Ted Kavanaugh
(74) *Attorney, Agent, or Firm* — Plumsea Law Group, LLC

(57) ABSTRACT

An article of footwear can receive an insert having ball control elements. The ball control elements protrude through a tongue of the upper to engage other surfaces. The inserts may be purchased separately from the article of footwear and interchanged to be used in a variety of conditions.

27 Claims, 19 Drawing Sheets

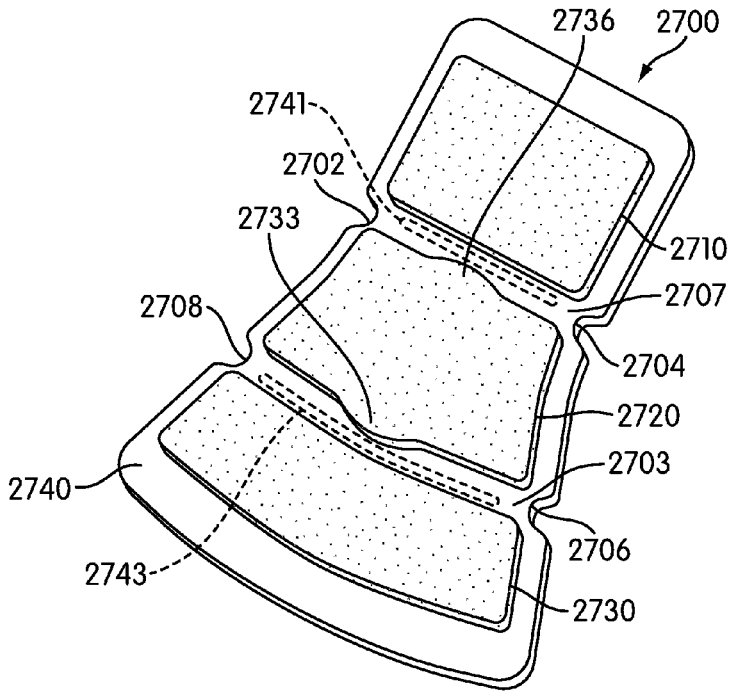
FIG. 16
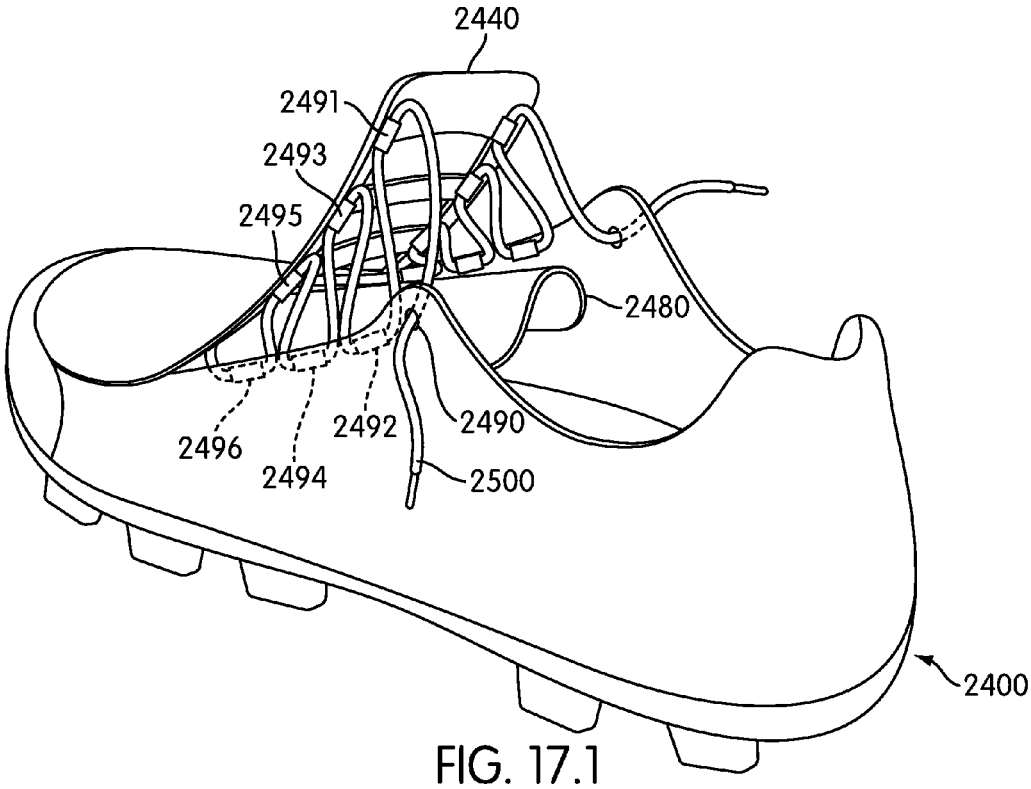
FIG. 17.1

FIG. 17.2

BALL CONTROL INSERT

BACKGROUND OF THE INVENTION

1. Field of the Invention

The invention relates to articles of footwear, and more particularly, articles of footwear having replaceable ball control elements.

2. Background of the Invention

Many sports require interaction between an athletic shoe upper and another surface. For example, in soccer, rugby, and football, players kick a ball with their foot. The point of contact where the athletic shoe touches the other surface can be referred to as an interaction surface. In addition, in rock climbing, a climber relies on friction from different portions of climbing shoes. In the past, participants in these sports were limited by the shoe they are wearing. Each pair of shoes was limited to have only one type of interaction surface.

Recently, ball control elements have been introduced. Ball control elements can be attached to a shoe to create a shoe that has a modified interaction surface. For example, a soccer style shoe having a ball control element on the forefoot and/or instep can have a refined kicking performance at the forefoot portion. For example, Japanese Patent Number JP9140402, to Saburo, is directed to an athletic shoe having ball control elements that are placed within the upper, however, the athletic shoe of Saburo only has one set of ball control elements.

Some athletic shoes are designed to receive inserts to accommodate changes in running styles or to replace treads. For example, U.S. Pat. No. 6,023,859, to Burke et al. discloses a shoe that receives sole inserts. The sole inserts can be replaced and configured for different running styles, like over-pronation. The inserts extend through openings in the sole, and are inserted from outside the shoe.

SUMMARY

An article of footwear including an insert with ball control elements is disclosed. In one aspect, the invention provides an article of footwear, comprising: an insert; a ball control element provided on the insert; an upper configured to receive the insert; and an opening defined in the upper, the opening configured so that the ball control element protrudes through the opening when the insert is received by the upper.

In another aspect, the article of footwear also includes an outer tongue provided on the upper; and an inner tongue provided between the outer tongue and an insole.

In another aspect, the insert is received between the outer tongue and the inner tongue.

In another aspect, the inner tongue includes a mesh portion.

In another aspect, the inner tongue includes a reinforced portion.

In another aspect, the article of footwear also includes a first set of lacing sockets provided on the outer tongue, and a second set of lacing sockets provided on the inner tongue.

In another aspect, the outer tongue includes grip elements.

In another aspect, the ball control element is interference fitted into the opening.

In another aspect, the invention provides an article of footwear comprising an upper, an outer tongue provided on the upper, bridges provided on the outer tongue, and an insert configured to be received in the upper, the insert having ball control elements provided on a first surface of the insert, the ball control elements being configured to receive the bridges.

In another aspect, the outer tongue has openings defined between the bridges to receive the ball control elements.

In another aspect, the article of footwear also includes fastener strips provided on the insert, and fastener receiving strips provided on the upper to receive the fastener strips on the insert.

In another aspect, the fastener receiving strips are disposed on the outer tongue.

In another aspect, the fastener receiving strips are disposed on an inner tongue associated with the upper.

In another aspect, the invention provides an article of footwear comprising an upper including an outer tongue and an inner tongue, an insert including a backing that can be received between an outer tongue and an inner tongue provided in an upper, a ball control element provided on the backing, and a lip provided on a portion of the ball control element, the lip being configured to engage a portion of the outer tongue.

In another aspect, the lip is configured to engage a bridge of the outer tongue.

In another aspect, the ball control element includes two or more lips.

In another aspect, the invention provides an article of footwear comprising a sole, an upper attached to the sole, a group of candidate inserts, a plurality of ball control elements provided on each of the candidate inserts, a plurality of openings provided in the upper to receive corresponding ball control elements, and wherein each insert of the group of inserts is configured to be received in the upper and wherein each insert of the group of inserts is manufactured to have a different type of ball control element.

In another aspect, the sole includes a cleat.

In another aspect, the group of inserts includes a insert having ball control elements configured with characteristics selected from the group consisting of accommodating wet conditions, increasing the power of kicking, increasing the accuracy of kicking, facilitating rock climbing, contacting a football, and contacting a soccer ball.

In another aspect, a pocket is provided in the upper, wherein the pocket is configured to receive any one of the group of candidate inserts.

Other configurations, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views. In the drawings:

FIG. 16 is a schematic diagram of a preferred embodiment of an insert;

FIG. 17.2 is a schematic diagram of another preferred embodiment of an article of footwear;

DETAILED DESCRIPTION

Embodiments of the present invention provide an article of footwear having interchangeable ball control elements. In particular, ball control elements are provided on an insert. A user can select among different inserts having different ball control elements and the article can receive the different types of insert. Thus, the ball control elements for an article can be easily changed by simply changing the insert.

The ball control elements can be associated with an insert. In some embodiments, an insert may be configured to be associated with an upper of an article of footwear. In a preferred embodiment, the insert may be associated with a tongue of an article of footwear.

Figure 1:
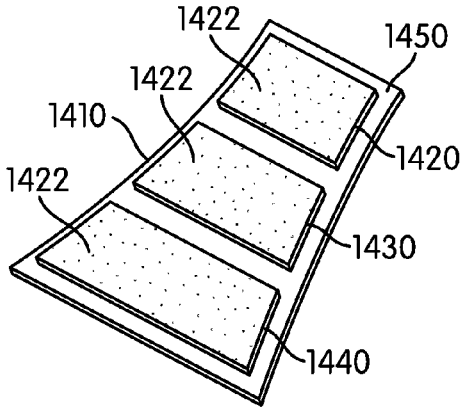
FIG. 1 is a schematic diagram illustrating a preferred embodiment of an insert.

FIG. 1 is a schematic diagram of a preferred embodiment of insert 1410. Insert 1410 may include one or more ball control elements. In the current embodiment, insert 1410 includes first ball control element 1420, second ball control element 1430, and third ball control element 1440. In a preferred embodiment, ball control elements 1420, 1430, and 1440 are preferably attached to backing 1450.

Although the current embodiment of insert 1410 includes three ball control elements 1420, 1430, and 1440, in other embodiments, insert 1410 may include more or less than three ball control elements. Generally, any number and configuration of ball control elements may be provided. In some embodiments, one large ball control element can be provided, for example, for a football punting embodiment.

In some embodiments, a ball control element may include provisions for gripping a surface that comes in contact with the ball control element. In the current embodiment, first ball control element 1420, second ball control element 1430, and third ball control element 1440 preferably include ball control surface 1422. In some cases, ball control surface 1422 is configured to make contact with, and tightly grip, the surface of a ball. In other cases, ball control surface 1422 may be configured to contact the surface of another object. In an alternative embodiment, ball control surface 1422 can be configured to interact with a rock surface in a rock climbing embodiment.

In some embodiments, the ball control surface can be hard in order to provide additional power for kicking a ball. In another preferred embodiment, the ball control surface can be softer to provide more control or accuracy over a ball that is kicked. Other embodiments of the ball control elements can have surfaces configured to interact with a ball in different types of weather, such as dry weather or wet weather, or other playing conditions. For example, in some embodiments, the ball control surface may be ribbed or textured to provide additional spin or control to the ball.

In some embodiments, an insert may be received by an article of footwear. In some embodiments, the insert may be provided in, for example, a forefoot region, a medial region, or a lateral region of the article. In addition, as described above, the insert may be configured to match a portion or region of the article in which the insert is to be received.

Figure 2:
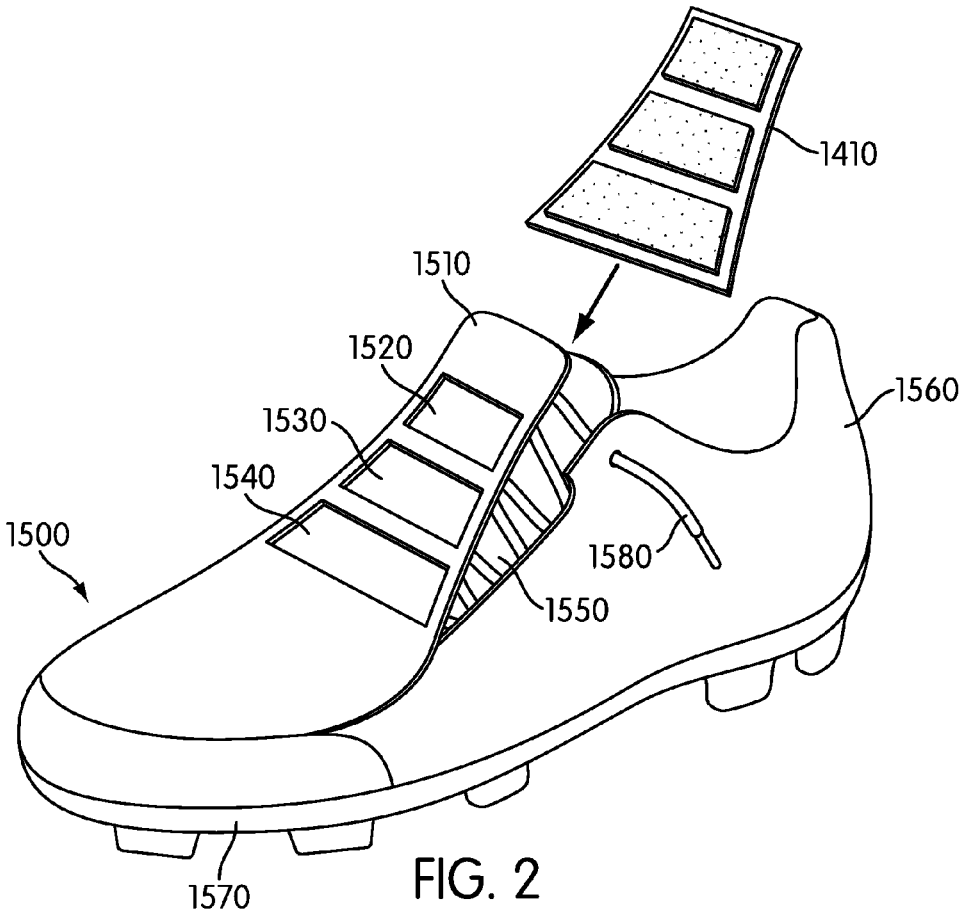
FIGS. 2-4 are schematic diagrams illustrating a preferred embodiment of an article configured to receive an insert.

FIG. 2 is a schematic diagram of a preferred embodiment of an article 1500 that is configured to receive insert 1410. Article 1500 preferably includes upper 1560. In some embodiments, upper 1560 may be further associated with sole 1570. In a preferred embodiment, upper 1560 may be attached directly to sole 1570 using an adhesive or another known method of attaching soles and uppers.

In some embodiments, an upper may be associated with one or more tongues that may be associated with an insert. In some cases, the upper may include an outer tongue that is associated with the insert. In other cases, the upper may include an inner tongue that is associated with the insert. In a preferred embodiment, the upper may be associated with both an inner tongue and an outer tongue that are configured to receive an insert.

In this current embodiment, upper 1560 preferably includes outer tongue 1510 and inner tongue 1550. In some embodiments, outer tongue 1510 and inner tongue 1550 may be associated with a fastening system that is configured to tighten article 1500. In this current embodiment, outer tongue 1510 and inner tongue 1550 may be associated with shoelace 1580 that is configured to tighten outer tongue 1510 and inner tongue 1550 together as article 1500 is fastened to a foot.

In some embodiments, the article can include provisions to receive and secure an insert. The provisions to receive and secure the insert may include mechanical provisions to secure the insert. In some embodiments, the article may include pockets that can hold the insert. In these embodiments, a pocket can securely hold the insert in place on the article. In other embodiments, additional provisions to secure the insert can include other devices configured to secure the insert, including buttons, Velcro, or screws. In a preferred embodiment, an insert may be held in place by an interference fit. Using an interference fit, the insert can be secured by friction between portions of the insert and portions of the article.

Figure 3:
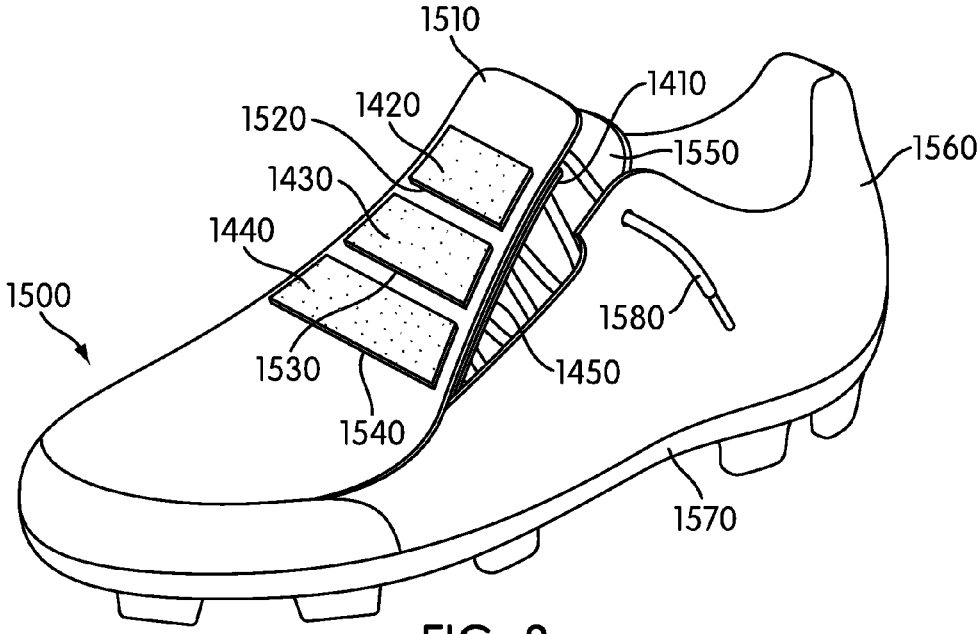
Figure 4:
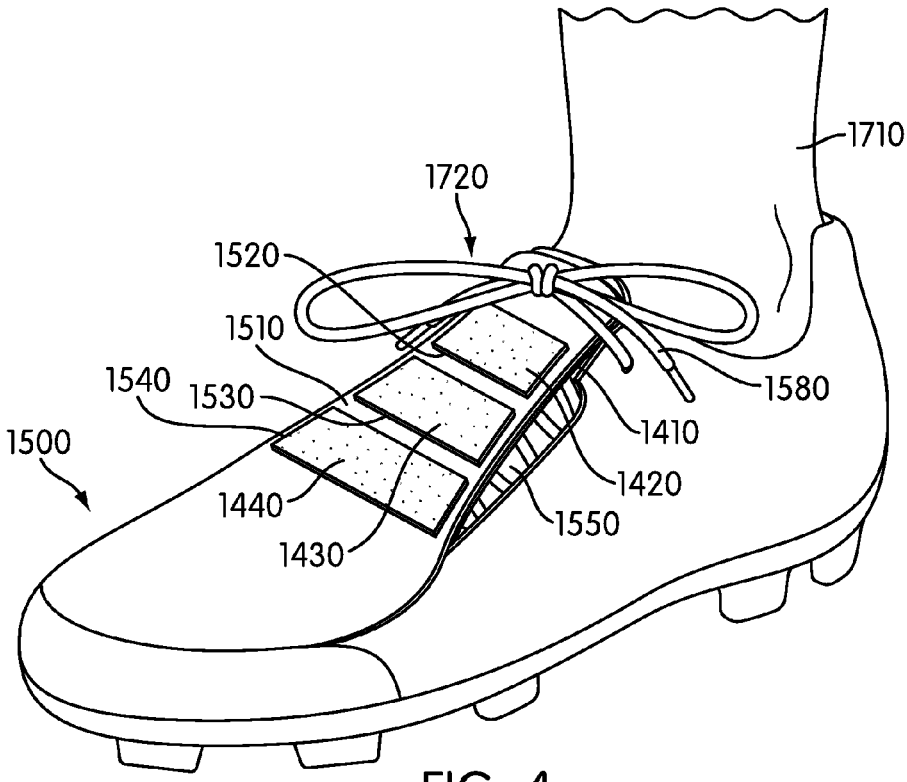
Figure 17:
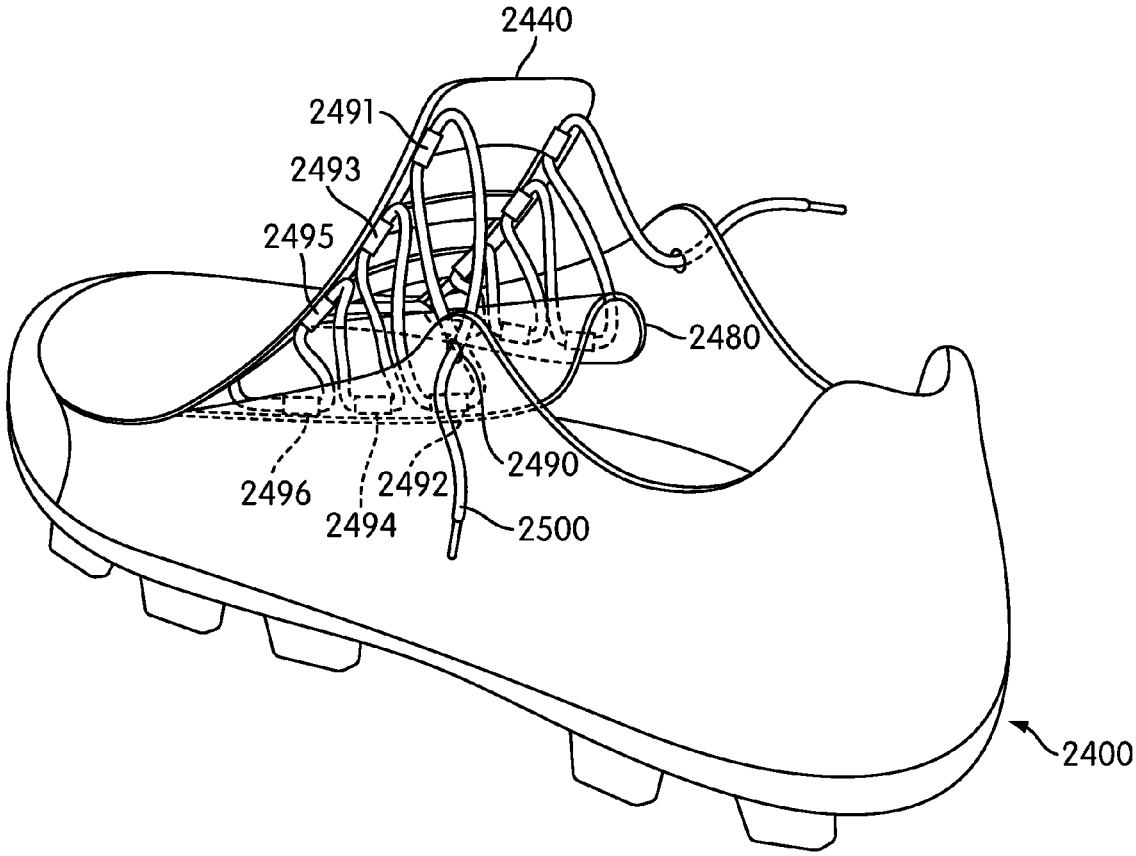
FIG. 17.1 is a schematic diagram of a preferred embodiment of an article of footwear.

Referring to FIGS. 2-4, insert 1410 may be associated with outer tongue 1510 and inner tongue 1550. Preferably, insert 1410 is received between inner tongue 1550 and outer tongue 1510. This arrangement allows insert 1410 to be sandwiched between outer tongue 1510 and inner tongue 1550, as seen in FIG. 3. In particular, backing 1450 preferably rests against the inner facing surface of outer tongue 1510 and the outer facing surface of inner tongue 1550. Furthermore, as shoelace 1580 is tightened and tied with knot 1720 following the insertion of foot 1710, outer tongue 1510 and inner tongue 1550 may apply tension to insert 1410 in order to keep insert 1410 in place, as seen in FIG. 17.2.

Preferably, ball control elements 1420, 1430 and 1440 may be disposed on an outer surface of upper 1560. In some embodiments, outer tongue 1510 may include openings or similar provisions to receive ball control elements 1420, 1430 and 1440. In this embodiment, first opening 1520, second opening 1530, and third opening 1540 are preferably disposed in outer tongue 1510. In this case, first ball control element 1420, second ball control element 1430, and third ball control element 1440 can preferably be received in respective first opening 1520, second opening 1530, and third opening 1540. In other embodiments, other arrangements of voids, windows, or openings can be provided to receive ball control elements provided on an insert. Using this preferred arrangement, ball control elements 1420, 1430 and 1440 can each be observed on an outer surface of article 1500.

In some embodiments, the sizes of openings configured to receive ball control elements may be varied. In some cases, the openings may be smaller than the ball control elements to reveal only a portion of the ball control elements along an outer surface of the upper. In other cases, the openings can be larger than the ball control elements. In a preferred embodiment, the openings can have a size that facilitates an interference fit with the ball control elements. In other words, the openings have a size equal to or slightly less than the associated ball control elements.

Figure 5:
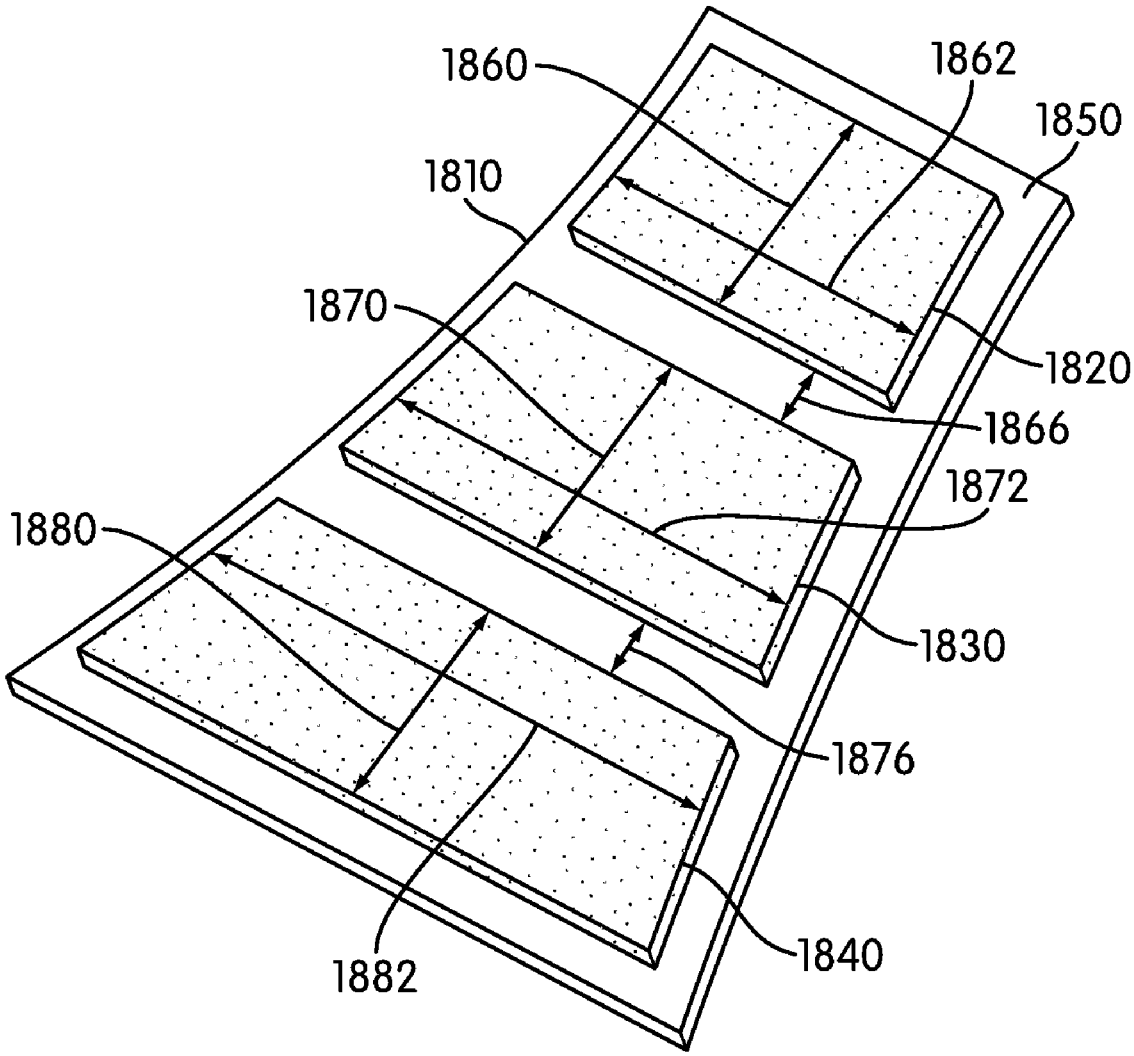
FIG. 5 is a schematic diagram of a preferred embodiment of an insert.
Figure 6:
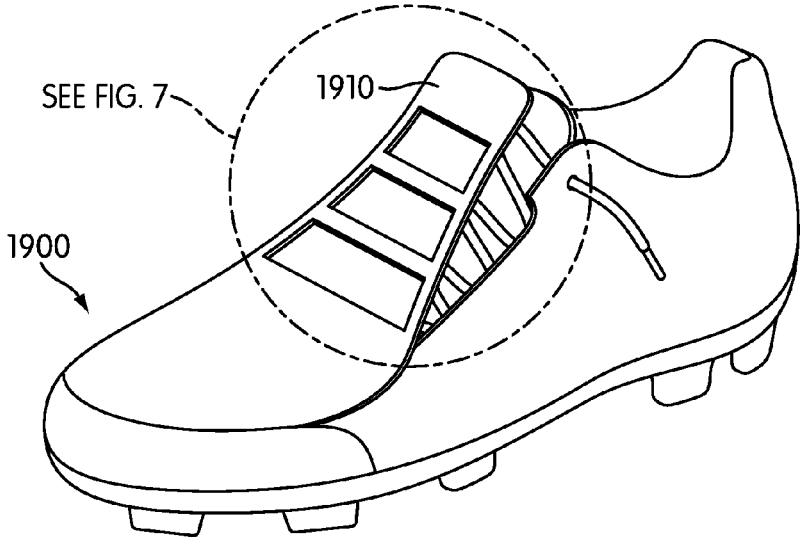
FIG. 6 is a schematic diagram of a preferred embodiment of an article of footwear.
Figure 7:
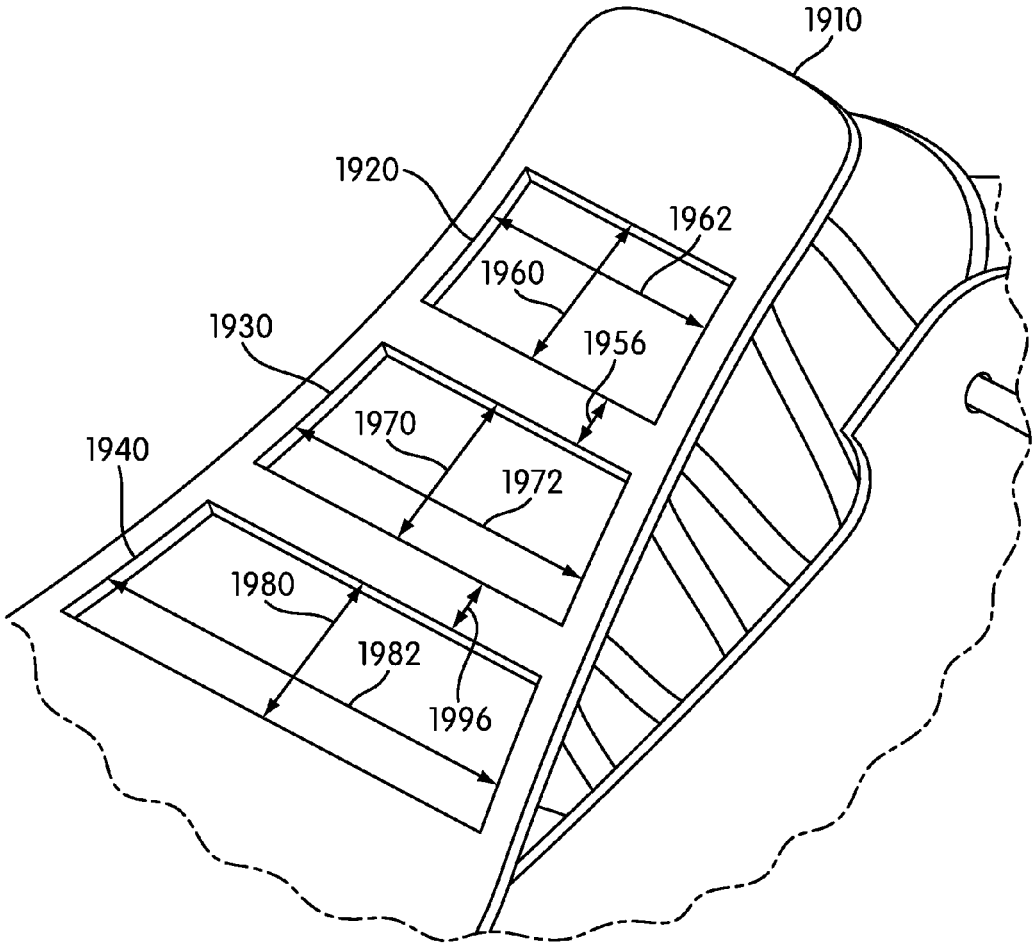
FIG. 7 is an enlarged view of a preferred embodiment of an outer tongue.
Figure 8:
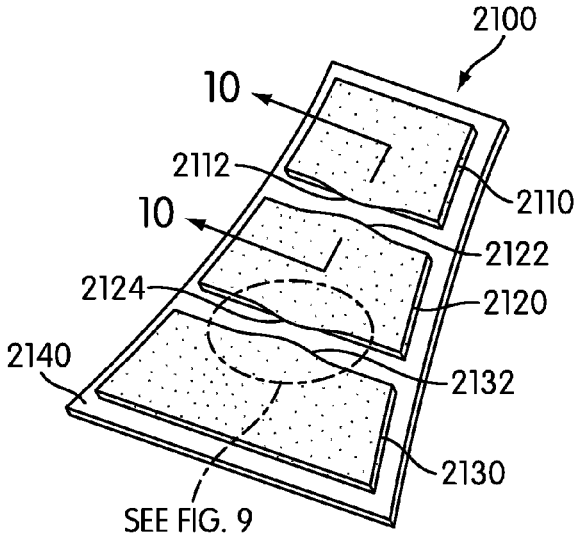
FIG. 8 is a schematic diagram of a preferred embodiment of an insert.

Referring to FIGS. 6-8, in the current embodiment, the sizes of the ball control elements may be substantially similar to the sizes of the openings in order to facilitate an interference fit. In this embodiment, insert 1810 preferably includes first ball control element 1820, second ball control element 1830, and third ball control element 1840 provided on backing 1850, as seen in FIG. 5. First ball control element 1820 preferably has first length 1860 and first width 1862. Likewise, second ball control element 1830 preferably has second length 1870 and second width 1872. Also, third ball control element 1840 preferably has third length 1880 and third width 1882.

Referring to FIGS. 7-8, first opening 1920, second opening 1930, and third opening 1940 are preferably defined in outer tongue 1910 of article 1900. Generally, the sizes of openings 1920, 1930 and 1940 may be similar to the sizes of ball control elements 1820, 1830 and 1840 respectively. In this embodiment, first opening 1920 has first length 1960 and first width 1962 that are substantially similar to first length 1860 and first width 1862 of first ball control element 1820. Likewise, second opening 1930 can have second length 1970 and second width 1972 that are substantially similar to second length 1870 and second width 1872 of second ball control element 1830. Additionally, third opening 1940 can have third length 1980 and third width 1982 that are substantially similar to third length 1880 and third width 1882 of third ball control element 1840. This arrangement preferably allows for an interference fit, as discussed above, to prevent ball control elements 1820, 1830 and 1840 from slipping in and out of openings 1920, 1930 and 1940, respectively. Furthermore, as ball control elements 1820, 1830 and 1840 are attached to backing 1850, this arrangement allows insert 1810 to be fixed in place with respect to outer tongue 1910.

In some cases, the separation distance between adjacent ball control elements may also be substantially similar to the separation distance between adjacent openings on the outer tongue in order to facilitate the interference fit. In this embodiment, as seen in FIG. 5, first ball control element 1820 is separated from second ball control element 1830 by first distance 1866. Likewise, second ball control element 1830 is separated from third ball control element by second distance 1876. Additionally, first opening 1920 is separated from second opening 1930 by third distance 1956. Also, second opening 1930 is separated from third opening 1940 by fourth distance 1996. Preferably, distances 1866 and 1876 are substantially similar to distances 1956 and 1996, respectively. This arrangement generally increases the effectiveness of the interference fit between insert 1810 and outer tongue 1910 by providing a proper alignment between ball control elements 1820, 1830, and 1840 and openings 1920, 1930 and 1940.

In some embodiments, an insert may include additional provisions for being secured in place with respect to an outer tongue. In some cases, a ball control element may include a lip that is configured to extend over a portion of the outer tongue. In other cases, the ball control element may include additional portions that are configured to extend over a portion of the tongue. Using this arrangement, the insert may be fixed in place with respect to the outer tongue.

Figure 9:
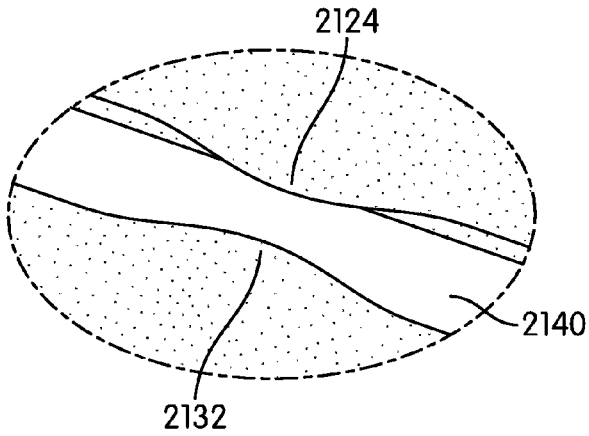
FIG. 9 is an enlarged view of a preferred embodiment of a second ball control element and a third ball control element.
Figure 10:
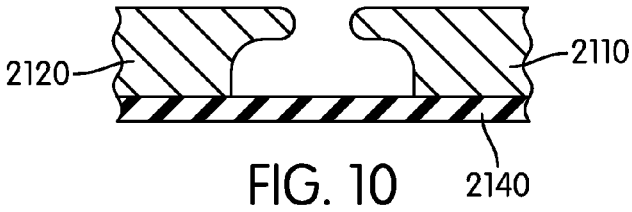
FIG. 10 is an enlarged side view of a preferred embodiment of a first lip and a second lip.

FIGS. 8-10 are a schematic diagram of a preferred embodiment of insert 2100. Referring to FIG. 8, insert 2100 preferably includes first ball control element 2110, second ball control element 2120, and third ball control element 2130 provided on backing 2140. In this embodiment, insert 2100 preferably includes first lip 2112, second lip 2122, third lip 2124 and fourth lip 2132. First lip 2112 preferably extends from first ball control element 2110. Additionally, in this embodiment, second lip 2122 and third lip 2124 preferably extend from second ball control element 2120. Fourth lip 2132 preferably extends from third ball control element 2130.

Although the current embodiment includes four lips, in other embodiments, any number of lips may be provided. In some cases, for example, multiple lips may be disposed along the periphery of each ball control element. Additionally, the shape, including the amount of extension, of each lip may be varied in other embodiments.

In some embodiments, a lip may hang over the backing of an insert. In other words, the lip may not touch the backing in some embodiments. FIG. 10 is an enlarged cross sectional view of a preferred embodiment of first lip 2112 and second lip 2122. In this embodiment, first lip 2112 preferably extends from first ball control element 2110 and hangs over backing 2140. Likewise, second lip 2122 preferably extends from second ball control element 2120 and hangs over backing 2140. This arrangement provides a gap or recess that may be engaged by a portion of the upper, in some cases.

Figure 11:
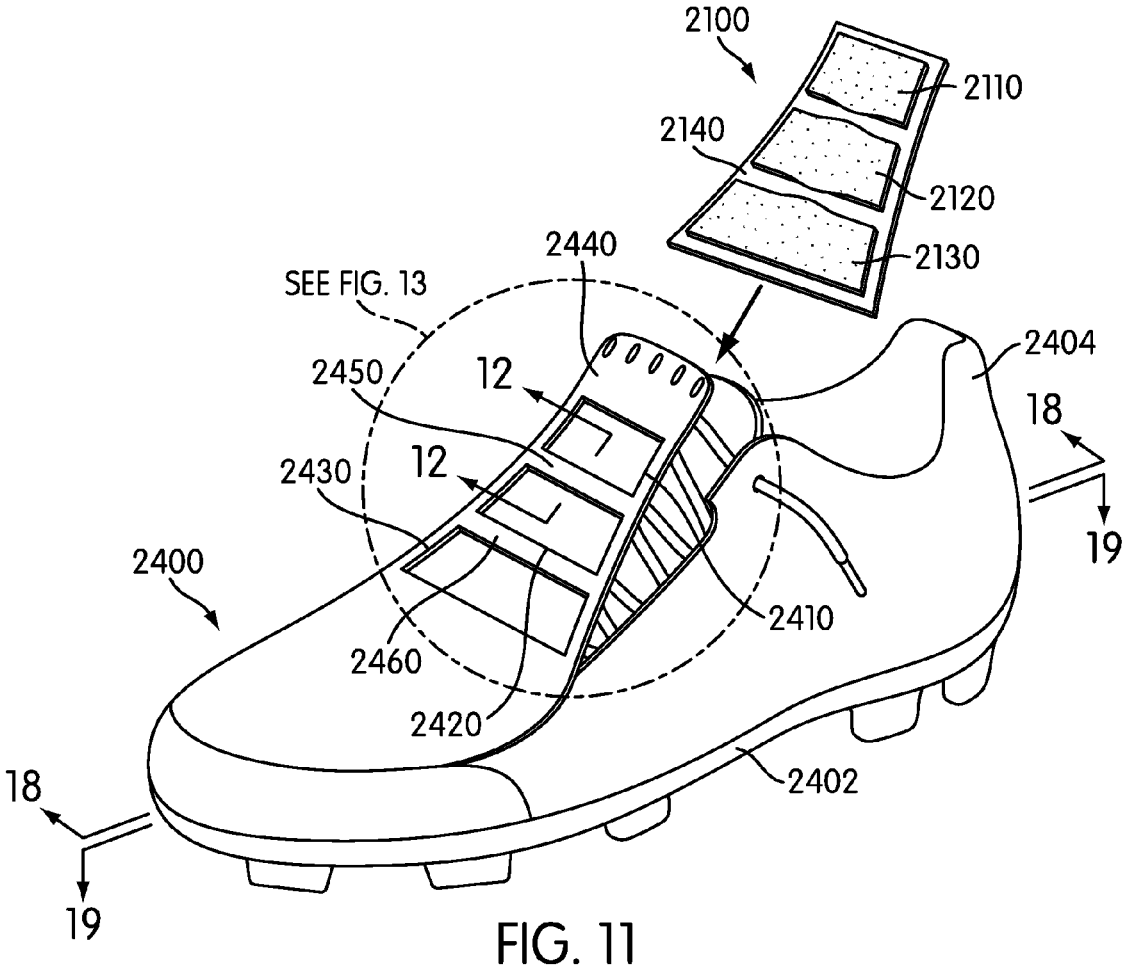
FIG. 11 is a schematic diagram of a preferred embodiment of an article of footwear and an insert.

In some embodiments, the insert can be associated with, and secured by, bridges provided on the outer tongue of the article of footwear. FIG. 11 is a schematic diagram of a preferred embodiment of article 2400, including upper 2404 and sole 2402. Preferably, article 2400 is associated with, and configured to receive, insert 2100.

Upper 2404 may include outer tongue 2440. In this embodiment, outer tongue 2440 includes first bridge 2450 that separates first opening 2410 and second opening 2420. Additionally, outer tongue 2440 includes second bridge 2460 that separates second opening 2420 and third opening 2430. In this case, bridges 2450 and 2460 preferably extend across the entire width of outer tongue 2440.

Figure 12:
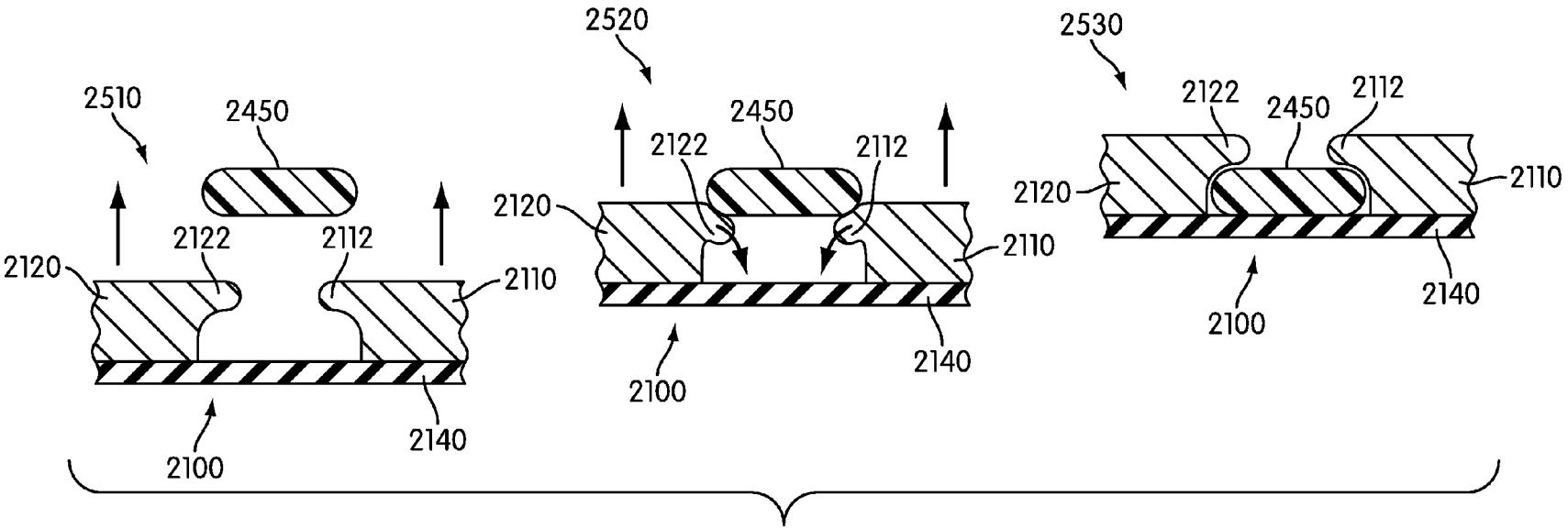
FIG. 12 is a cross sectional view of a preferred embodiment of a first bridge being received by a first lip and a second lip.

FIG. 12 illustrates a preferred embodiment of first bridge 2450 being received by first lip 2112 and second lip 2122. Referring to FIG. 12, first bridge 2450 can be received between first ball control element 2110 and second ball control element 2120. As first bridge 2450 is received between first ball control element 2110 and second ball control element 2120, first lip 2112 and second lip 2122 can be translated to allow first bridge 2450 past. In addition, first bridge 2450 can also flex or bend to fit between first lip 2112 and second lip 2122.

During a first position 2510 of insert 2100, first lip 2112 and second lip 2122 approach first bridge 2450. Following this, during a second position 2520 of insert 2100, first lip 2112 and second lip 2122 can bend downward to allow first bridge 2450 through. In some embodiments, first bridge 2450 may also bend or otherwise deform. In other embodiments, either or both of the first bridge 2450 or lips 2112 and 2122 can deform. By deforming, first bridge 2450 can fit between first lip 2112 and second lip 2122.

Following this, in a third position 2530 of insert 2100, first bridge 2450 is received between first lip 2112 and second lip 2122. At this point, first lip 2112 and second lip 2122 return to their previous positions. In some cases, first bridge 2450 may also return to an original shape. In a preferred embodiment, first bridge 2450 can remain deformed. By remaining deformed, first bridge 2450 can provide additional force to secure insert 2100.

Generally, each lip on a portion of a ball control element may be configured to deform and receive a portion of a bridge of an outer tongue. In particular, third lip 2124 and fourth lip 2132 are preferably configured to deform and receive second bridge 2460 (see FIGS. 8 and 11) in a manner similar to the way that first bridge 2450 is received by lips 2112 and 2122.

Figure 13:
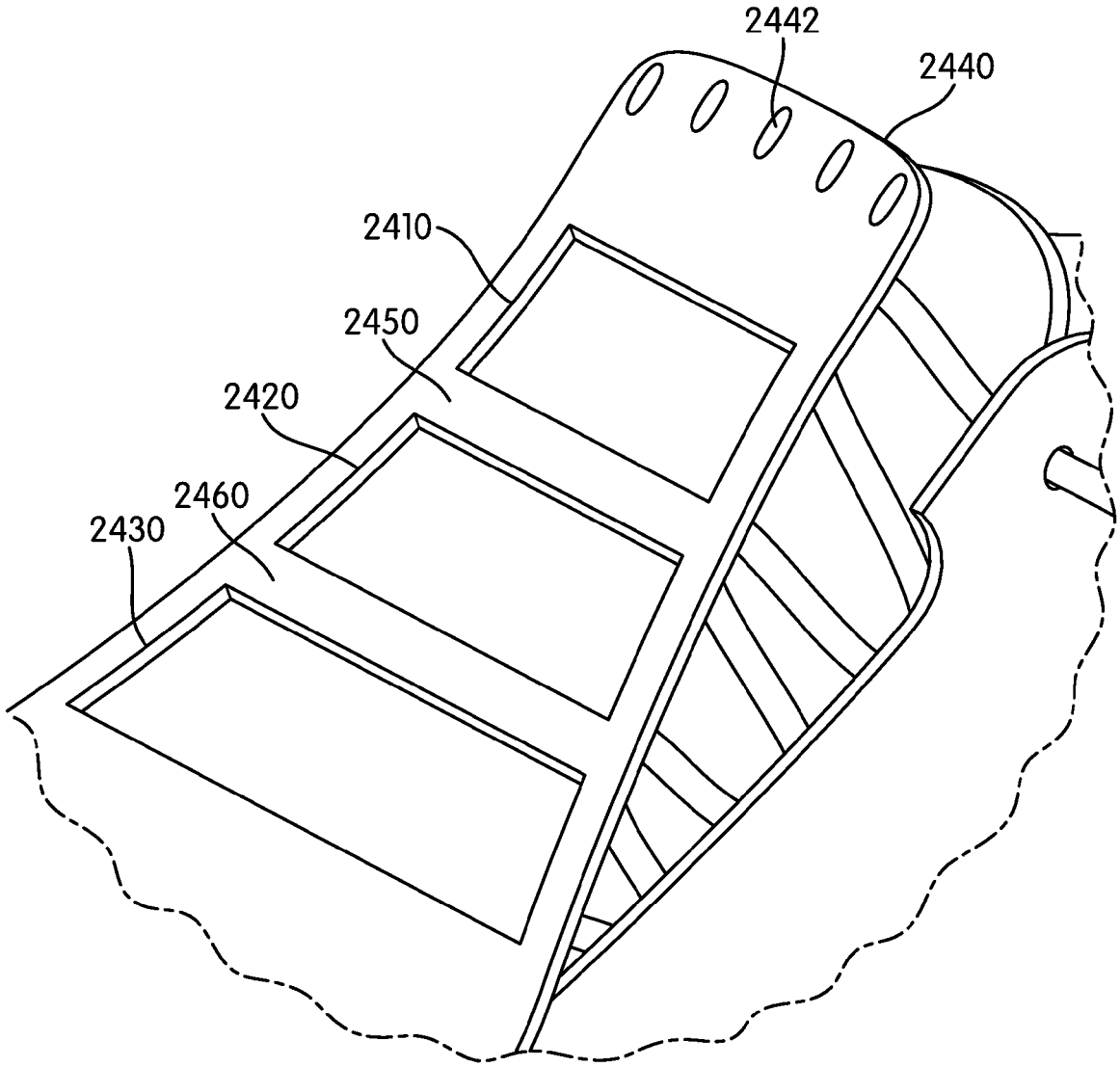
FIG. 13 is an enlarged view of a preferred embodiment of the outer tongue of FIG. 11.

In some embodiments, the article of footwear can include provisions that allow a user to grasp the tongue. For example, FIG. 13 is an enlarged view of a portion of a preferred embodiment of article 2400. Referring to FIG. 13, outer tongue 2440 can include grip elements 2442 provided on an outer end of outer tongue 2440. Accordingly, a user can grip outer tongue 2440 while securing an insert to outer tongue 2440.

Figure 14:
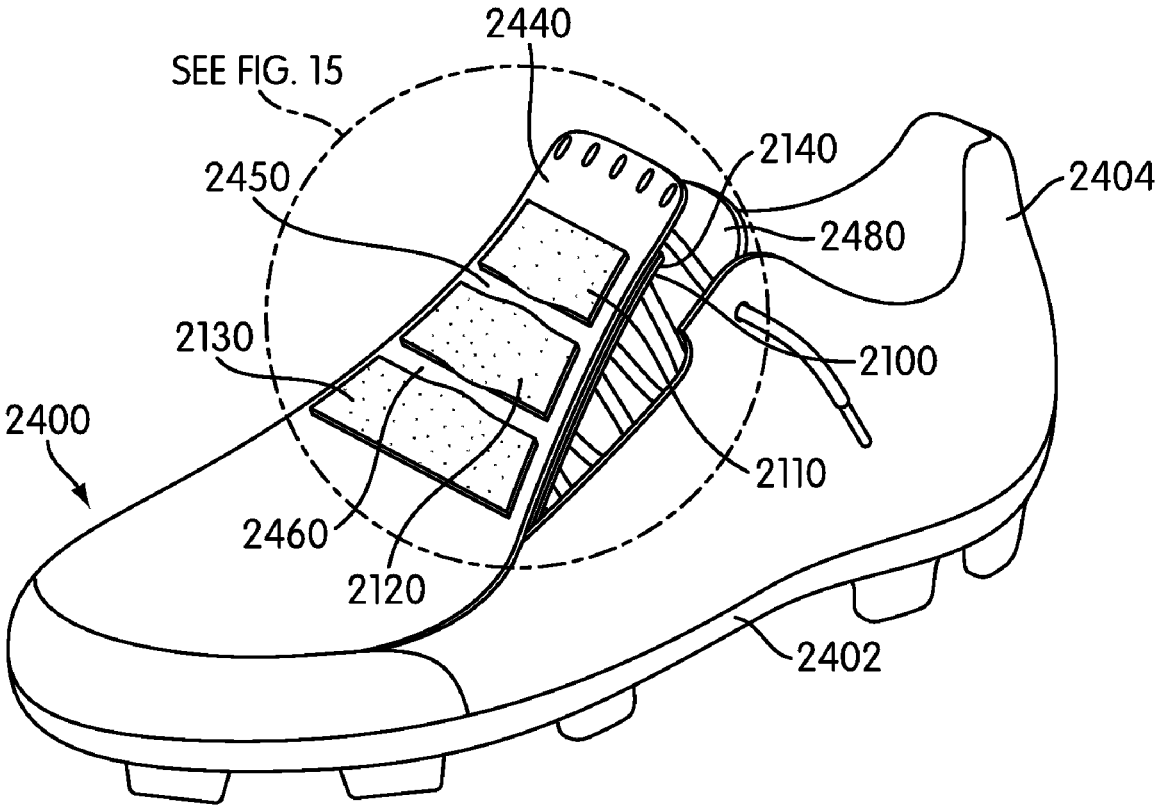
FIG. 14 is a schematic diagram of a preferred embodiment of an article and an insert.
Figure 15:
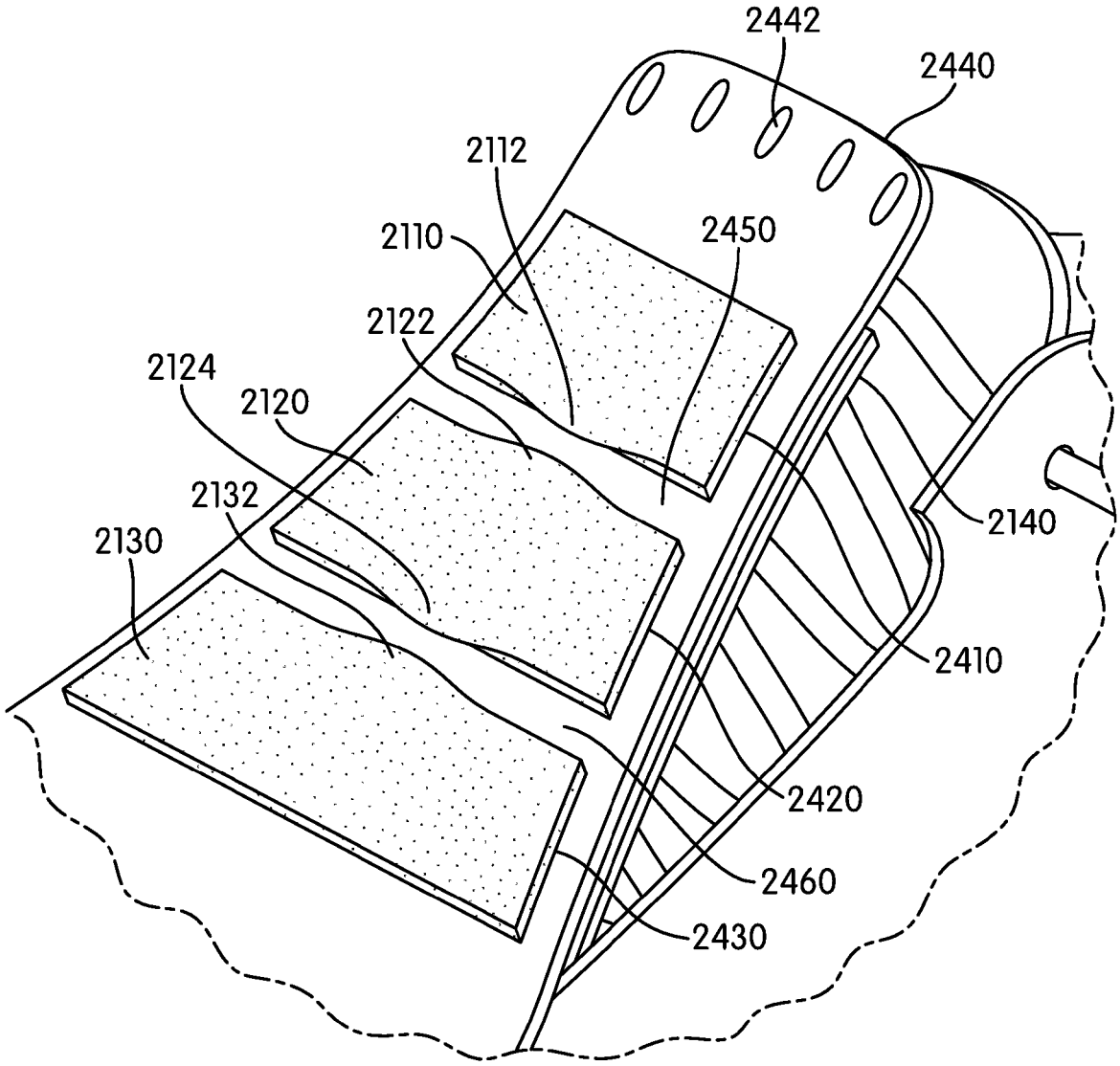
FIG. 15 is an enlarged view of a preferred embodiment of the article and the insert of FIG. 14.

FIGS. 14-15 are a preferred embodiment of article 2400. In this embodiment, insert 2100 has been inserted between outer tongue 2440 and inner tongue 2480. As insert 2100 is received within article 2400, first ball control element 2110 can preferably be received in first opening 2410, second ball control element 2120 can preferably be received in second opening 2420, and third ball control element 2130 can preferably be received in third opening 2430.

In addition to the ball control elements being received in their respective openings, the lips of the ball control elements can engage portions of the tongue. Referring to FIG. 15, first bridge 2450 is received between first ball control element 2110 and second ball control element 2120. In this embodiment, first lip 2112 and second lip 2122 can cover portions of first bridge 2450 to secure insert 2100 to article 2400. Also, third lip 2124 and fourth lip 2132 can cover portions of second bridge 2460 to further secure insert 2100 to article 2400. In other embodiments, any arrangement of ball control elements on an insert can be secured by any number of bridges. In addition, in some embodiments, portions of backing 2140 may be visible through any of the openings 2410, 2420 and 2430.

In some embodiments, an insert can include provisions for increased flexibility. In some cases, an insert could include one or more cutouts to improve flexibility of the insert. In a preferred embodiment, an insert could include cutouts that are associated with one or more portions of the outer tongue.

FIG. 16 is a schematic diagram of a preferred embodiment of insert 2700. Referring to FIG. 16, insert 2700 can include first ball control element 2710, second ball control element 2720, and third ball control element 2730 provided on backing 2740. In this embodiment, second ball control element 2720 includes first lip 2731 and second lip 2733 that are configured to engage openings on an outer tongue.

In this embodiment, insert 2700 also preferably includes cutouts. Insert 2700 may include first cutout 2702 and second cutout 2704 that are associated with first portion 2701. Also, insert 2700 may include third cutout 2706 and fourth cutout 2708 that are associated with second portion 2703. Using this arrangement, insert 2700 may have increased flexibility at first portion 2701 and second portion 2703.

In other embodiments, a channel can also be provided in the top surface of backing 2740 between either first cutout 2702 and second cutout 2704 and third cutout 2706 and fourth cutout 2708 to improve flexibility of insert 2700. In some cases, backing 2740 may be provided with first channel 2741, which is shown here in phantom. In other cases, backing 2740 may be provided with second channel 2743, which is also shown in phantom. It should be understood that channels 2741 and 2743 are intended to be optional and may not be included in all embodiments. Using this channel arrangement may preferably facilitate increased flexibility of insert 2700.

In some embodiments, an article of footwear may include provisions to prevent a set of laces from interfering with an insert. In some cases, the set of laces may be associated with an outer periphery of an outer tongue. In a preferred embodiment, the set of laces may be disposed through a set of lacing sockets that are disposed on the outer periphery of the outer tongue.

FIG. 17.2 is a schematic diagram of a preferred embodiment of article 2400. Referring to FIG. 17.2, shoelace 2500 can be provided to secure article 2400. In this embodiment, outer tongue 2440 may include first lacing socket 2491, second lacing socket 2493, and third lacing socket 2495, comprising a first set of lacing sockets that are configured to guide shoelace 2500. Additionally, in this embodiment, inner tongue 2480 may include fourth lacing socket 2492, fifth lacing socket 2494 and sixth lacing socket 2496, comprising a second set of lacing sockets that are also configured to guide shoelace 2500. Using this arrangement, shoelace 2500 may be guided in an alternating configuration through lacing sockets 2491, 2492, 2493, 2494, 2495 and 2496.

Preferably, each of the lacing sockets 2491, 2492, 2493, 2494, 2495 and 2496 that are disposed on a lateral side of article 2400 are further associated with identical lacing sockets on a medial side of article 2400. In particular, shoelace 2500 may also be guided through these additional lacing sockets as well. Furthermore, each end of shoelace 2500 may be associated with eyelets 2490. This configuration allows outer tongue 2440 to be pulled tight with inner tongue 2480 as shoelace 2500 is tightened. Using this arrangement may also help prevent shoelace 2500 from interfering with an insert as the shoelace may be disposed on a periphery of outer tongue 2440. Alternatively, as shown in FIG. 17.1, lacing sockets 2492, 2494 and 2496, and their corresponding lacing sockets on the medial side of article 2400, may be provided on the upper of an article 2400 instead of on inner tongue 2480.

Figure 18:
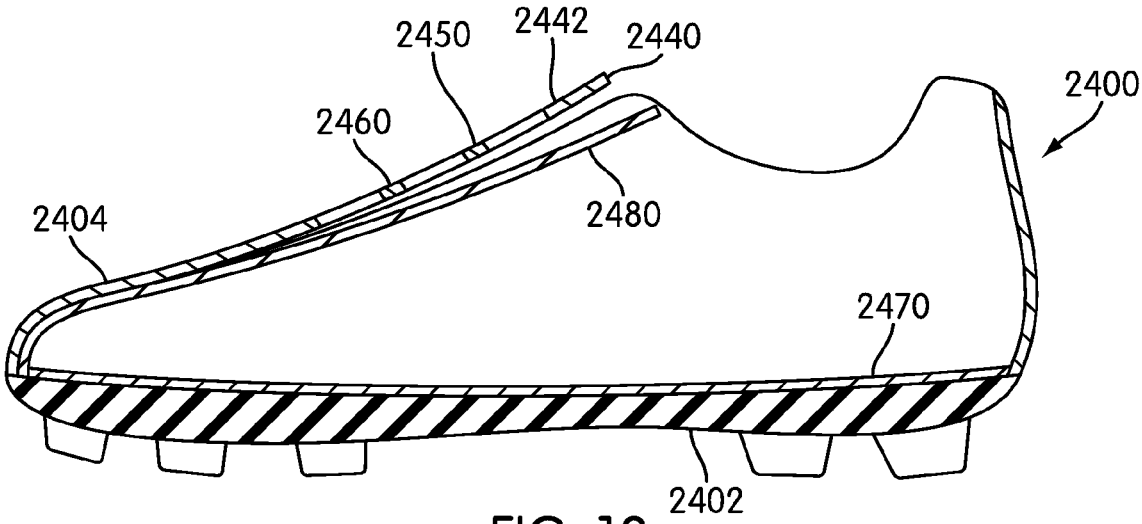
FIGS. 18 and 19 are cross sectional views of a preferred embodiment of the article of footwear of FIG. 11.

In some embodiments, an article of footwear may also include an insole. FIG. 18 is a cross sectional view of a portion of a preferred embodiment of article 2400. Article 2400 preferably includes sole 2402 and upper 2404. In this embodiment, insole 2470 can be provided over sole 2402. Article 2400 may also preferably include inner tongue 2480. In some cases, inner tongue 2480 can extend from upper 2404. In a preferred embodiment, inner tongue 2480 may extend from insole 2470.

In some embodiments, the inner tongue can include provisions for comfort. In some cases, an inner tongue may include mesh to provide breatheability to an upper. In other cases, the inner tongue may be made of another material configured to increase the breatheability of the upper.

Figure 19:
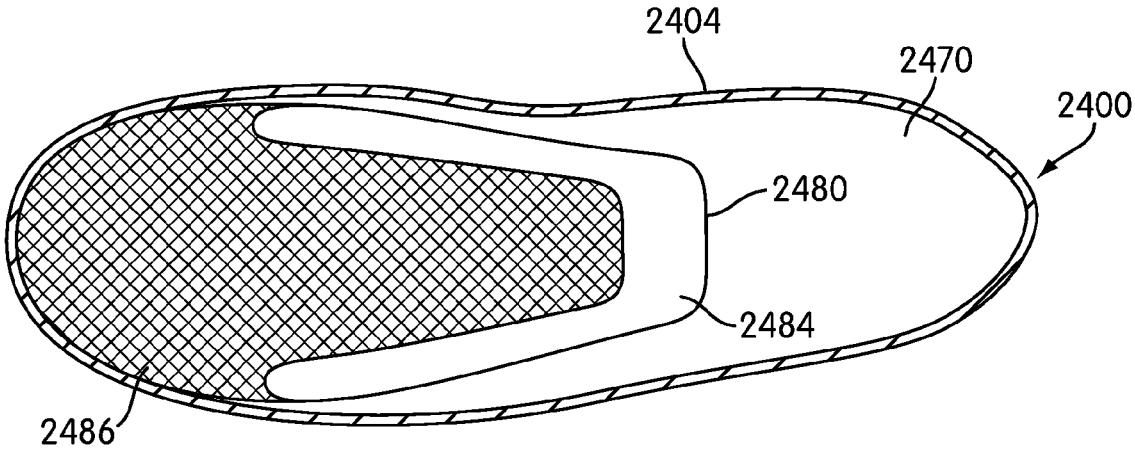

FIG. 19 is a top cross sectional view of a portion of a preferred embodiment of article 2400. In some cases, inner tongue 2480 may include mesh portion 2486. In other cases, inner tongue 2480 may also include reinforced portion 2484. Reinforced portion 2484 can be provided on an outer portion of inner tongue 2480. In a preferred embodiment, inner tongue 2480 includes both mesh portion 2486 and reinforced portion 2484.

In some embodiments, the insert can include additional provisions to associate with the article of footwear. In some embodiments, a fastener may be used to secure the insert to the article. In some cases, the fastener could be a hook and loop fastener. In other cases, the fastener could be any type of fastener, including, but not limited to, zippers, buttons, snaps, as well as other types of releasable fasteners. In a preferred embodiment, a hook-and-loop type fastener, such as Velcro®, may be used.

Figure 20:
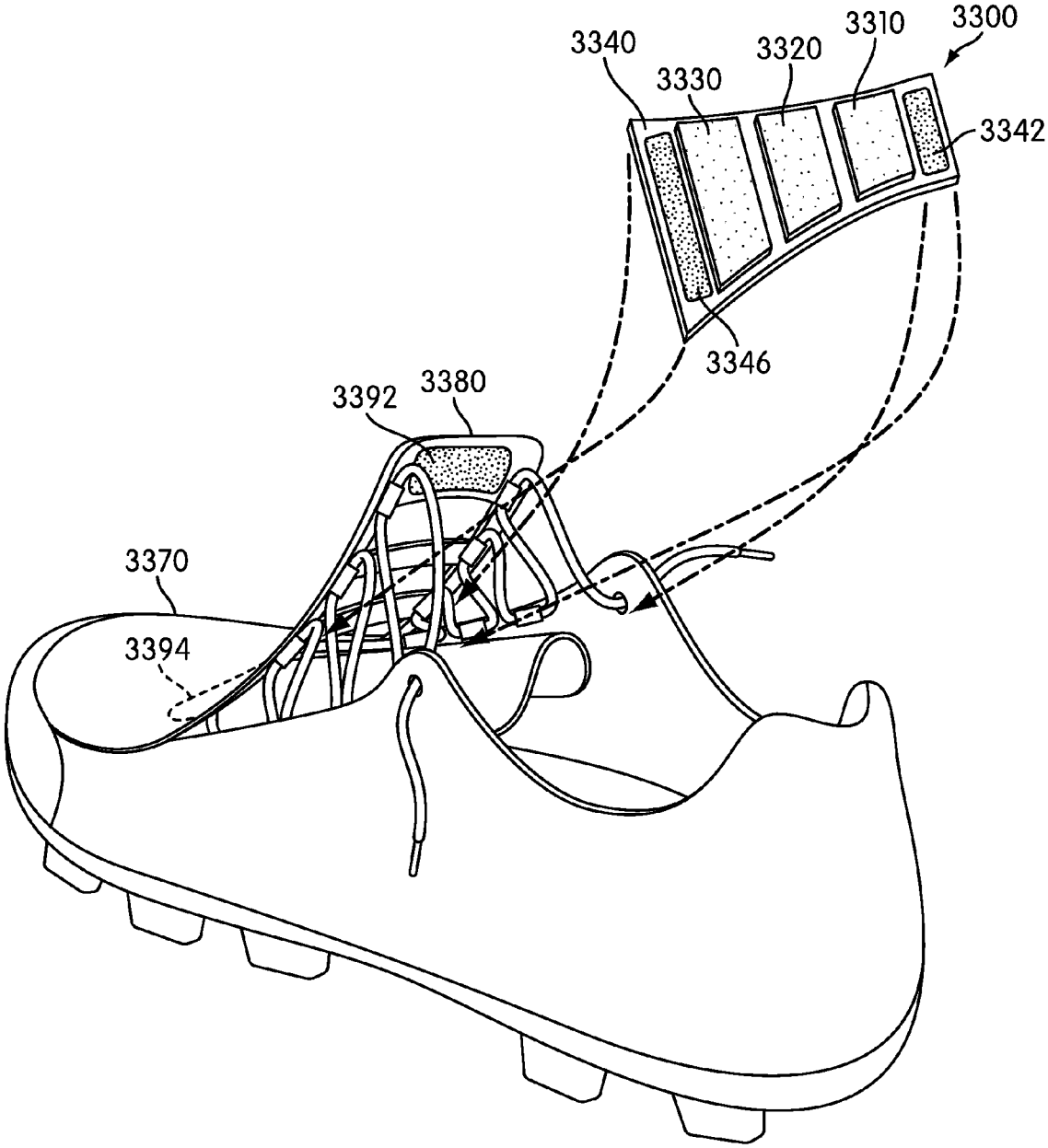
FIG. 20 is a schematic diagram of a preferred embodiment of an insert and an article of footwear.

FIG. 20 is a schematic diagram of a preferred embodiment of article 3370 that is configured to receive insert 3300. Referring to FIG. 20, insert 3300 preferably includes backing 3340. Additionally, insert 3300 may include first ball control element 3310, second ball control element 3320, and third ball control element 3330 that are provided on a first side of backing 3340.

In this embodiment, insert 3300 includes first fastener strip 3342 on a first side of backing 3340. First fastener strip 3342 may be disposed adjacent to first ball control element 3310. Additionally, insert 3300 also preferably includes second fastener strip 3346 on the first side of backing 3340. Second fastener strip 3346 may be disposed adjacent to third ball control element 3330.

Preferably, outer tongue 3380 of article 3370 includes provisions for receiving first fastener strip 3342 and second fastener strip 3346 of insert 3300. In this embodiment, outer tongue 3380 may include first fastener receiving strip 3392 and second fastener receiving strip 3394. Fastener receiving strips 3392 and 3394 are preferably provided on outer tongue 3380. Furthermore, other embodiments of article 3370 can have different arrangements of fastener receiving strips and it is preferable that the fastener receiving strips on article 3370 match the fastener strips on insert 3300. Using this preferred arrangement, insert 3300 is fastened to article 3370 using fastener strips 3342 and 3346 as well as fastener receiving strips 3392 and 3394.

While two fastener strips are illustrated in this embodiment, any number or arrangement of fastener strips may be provided on insert 3300. In some embodiments, additional fastener strips may be disposed between adjacent ball control elements. In still other embodiments, only one fastener strip may be associated with insert 3300. Additionally, in other embodiments, outer tongue 3380 may include any number or arrangement of fastener receiving strips configured to receive the various fastener strips.

Figure 21:
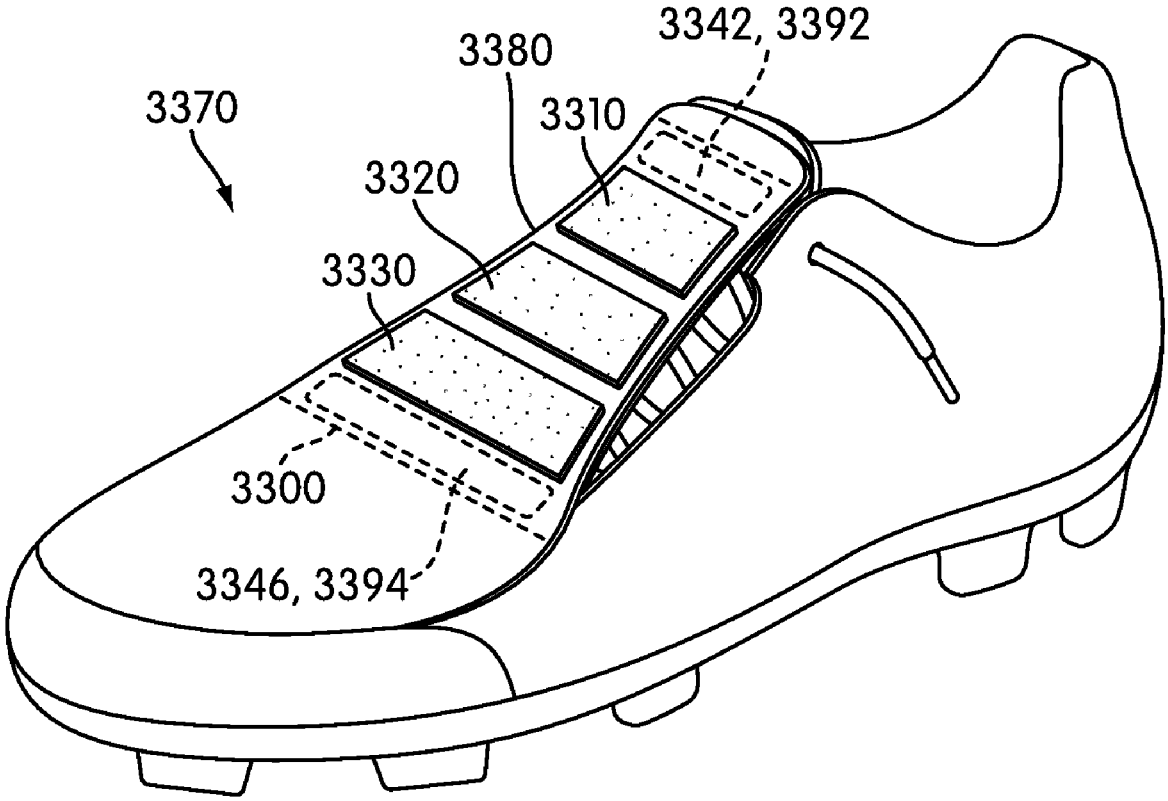
FIG. 21 is a schematic diagram of a preferred embodiment of an insert associated with an article of footwear.

FIG. 21 is a schematic diagram of a preferred embodiment of article 3370 associated with insert 3300. In this embodiment, first fastener strip 3342 and second fastener strip 3346 are configured to adhere to first fastener receiving strip 3392 and second fastener receiving strip 3394. This arrangement generally secures insert 3300 to outer tongue 3380. Furthermore, with this preferred arrangement, first ball control element 3310, second ball control element 3320, and third ball control element 3330 may protrude through outer tongue 3380.

Figure 22:
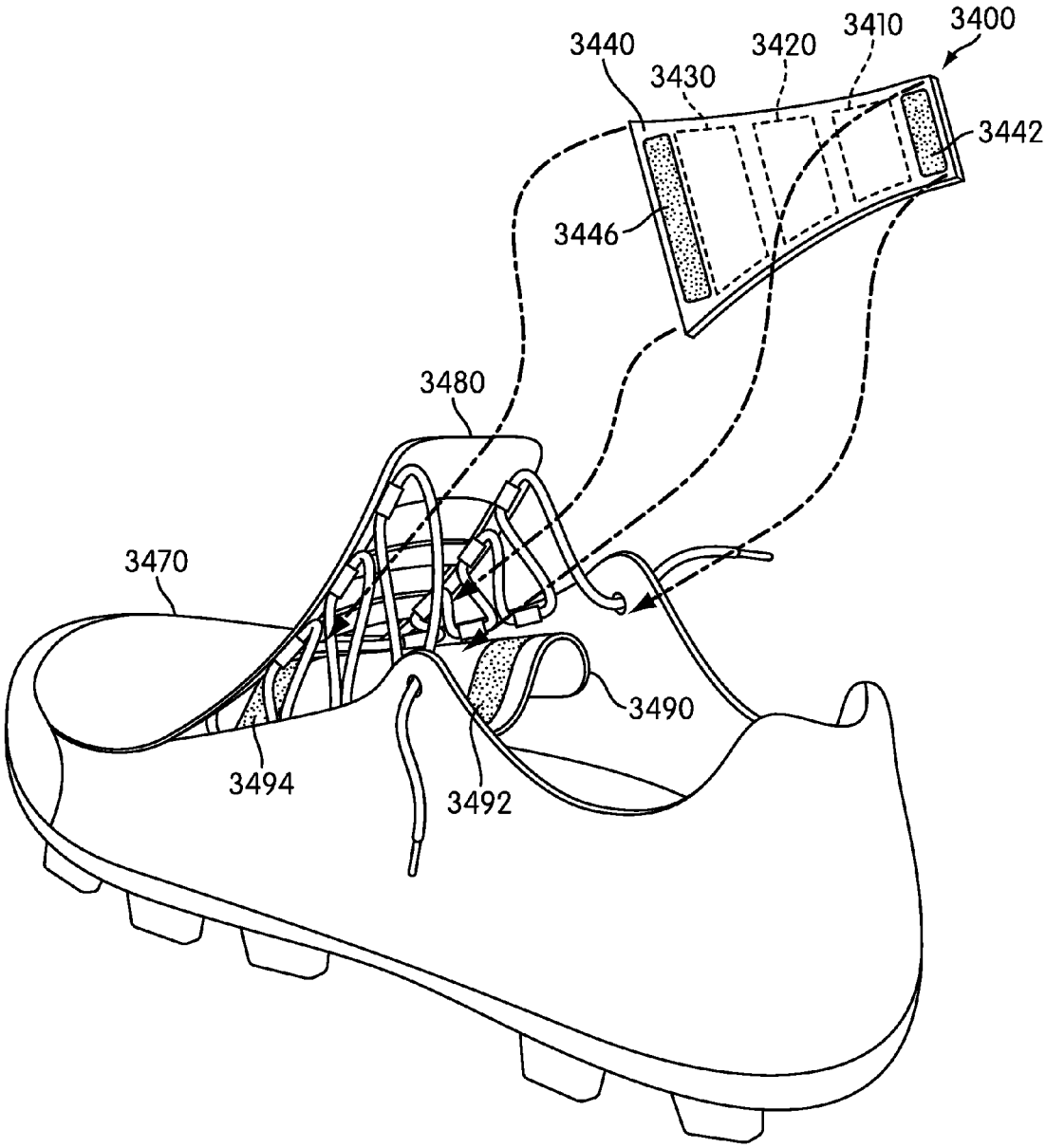
FIG. 22 is a schematic diagram of a preferred embodiment of an insert and an article of footwear.

Referring to FIG. 22, in another embodiment, an insert may be configured to attach to an inner tongue of an article. In this embodiment, insert 3400 is associated with article 3470. Insert 3400 preferably includes backing 3440. Additionally, insert 3400 may include first ball control element 3410, second ball control element 3420, and third ball control element 3430.

In this embodiment, first fastener strip 3442 and second fastener strip 3446 are preferably provided on a second side of backing 3440 that is associated with inner tongue 3490. Likewise, first fastener receiving strip 3492 and second fastener receiving strip 3494 are disposed on inner tongue 3490. Preferably, fastener receiving strips 3492 and 3494 are configured to receive fastener strips 3442 and 3446. With this arrangement, insert 3400 may be fastened to inner tongue 3490 to prevent insert 3400 from slipping between outer tongue 3480 and inner tongue 3490.

Figure 23:
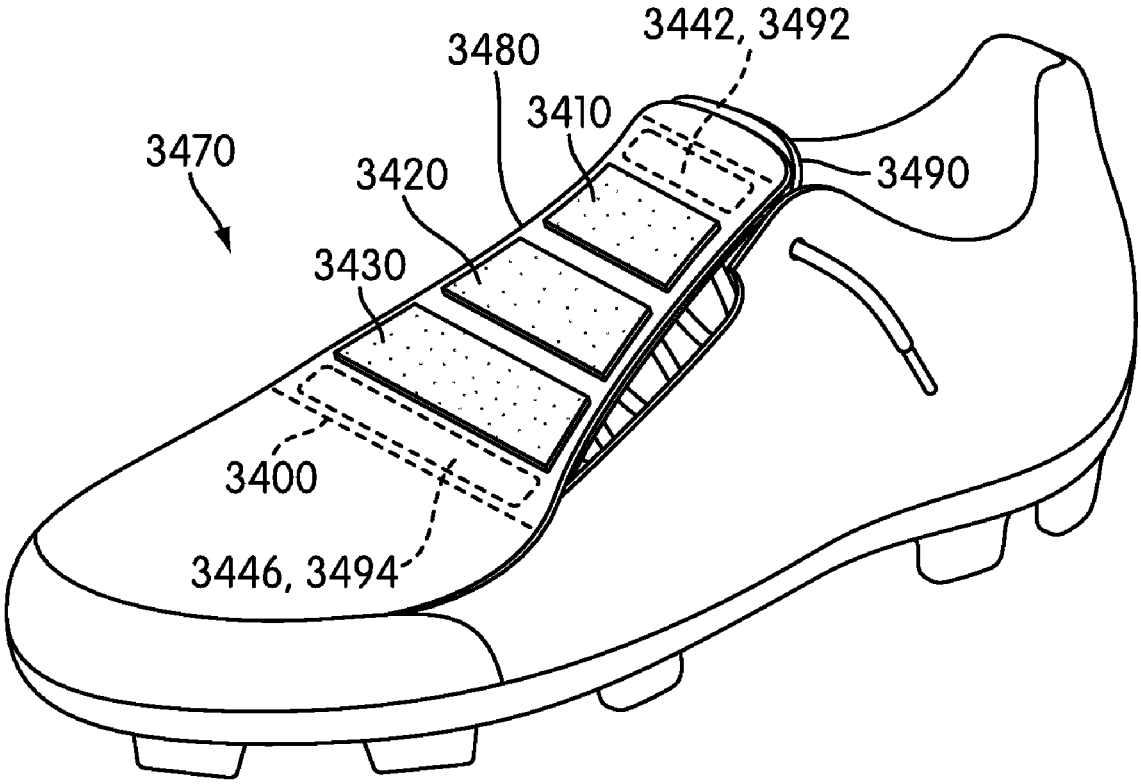
FIG. 23 is a schematic diagram of a preferred embodiment of an article of footwear associated with an insert.

FIG. 23 is a schematic diagram of a preferred embodiment of article 3470 associated with insert 3400. In this embodiment, first fastener strip 3442 and second fastener strip 3446 are configured to adhere to first fastener receiving strip 3492 and second fastener receiving strip 3494, respectively. This arrangement generally secures insert 3400 to inner tongue 3490. Furthermore, with this preferred arrangement, first ball control element 3410, second ball control element 3420, and third ball control element 3430 may protrude through outer tongue 3480.

Figure 24:
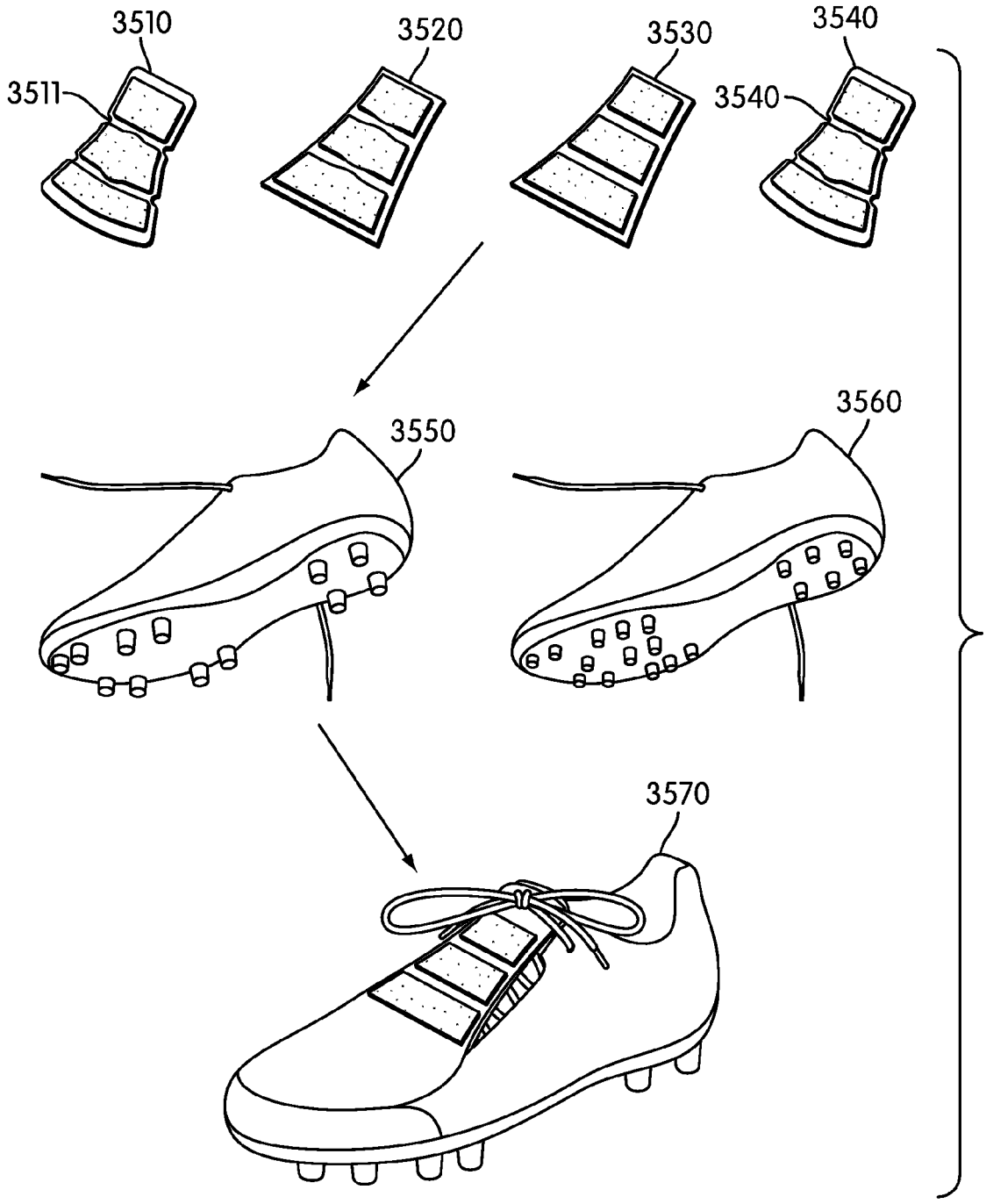
FIG. 24 is a diagram of a system of selecting an article of footwear according to a preferred embodiment.

FIG. 24 is a diagram of a system of selecting an article of footwear according to an embodiment. Referring to FIG. 24, a user can select from several different elements to create a custom article of footwear. As can be observed, the user can choose from first insert 3510, second insert 3520, third insert 3530, or fourth insert 3540. However, in other embodiments, any number of different inserts can be available for the user to choose.

Each of first insert 3510, second insert 3520, third insert 3530, and fourth insert 3540 can have different arrangements and properties. For example, in this embodiment, first insert 3510 and second insert 3520 can have dry weather ball control elements. In some cases, a user may select first insert 3510 because first insert 3510 includes cutouts 3511 that may increase flexibility. On the other hand, the user can select second insert 3520 because second insert 3520 does not include cutouts and is configured to be more rigid, which may be useful for certain types of kicks.

On the other hand, the user may also choose from the styles of third insert 3530 and fourth insert 3540. Third insert 3530 and fourth insert 3540 both include ball control elements that are configured for wet weather conditions. In one embodiment, third insert 3530 can be water proof or water resistant. Similarly, fourth insert 3540 can be water proof or water resistant and may include cutouts 3541 to increase flexibility of fourth insert 3540.

First article 3550 and second article 3560 are preferably configured to associate with first insert 3510, second insert 3520, third insert 3530, and fourth insert 3540. Preferably, first article 3550 and second article 3560 have openings that correspond to ball control elements on first insert 3510, second insert 3520, third insert 3530, and fourth insert 3540. Accordingly, the user can choose from either first article 3550 or second article 3560 into which any of first insert 3510, second insert 3520, third insert 3530, and fourth insert 3540 can be inserted and worn.

In addition, first article 3550 can be an embodiment having large cleats that are spaced apart while second article 3560 has smaller cleats that are spaced closer together. It can also be observed that second article 3560 is a high top model while first article 3550 is a low top model.

Different combinations of first insert 3510, second insert 3520, third insert 3530, or fourth insert 3540 and first article 3550 or second article 3560 can be associated to create different articles of footwear. It can be observed that third insert 3530 and first article 3550 have been joined to create modified article 3570. Accordingly, modified article 3570 has large cleats and an insert with wet weather ball control elements.

However, it can be understood that in a preferred embodiment, the user can have many more options available. The options can include many different styles of inserts and articles.

Figure 25:
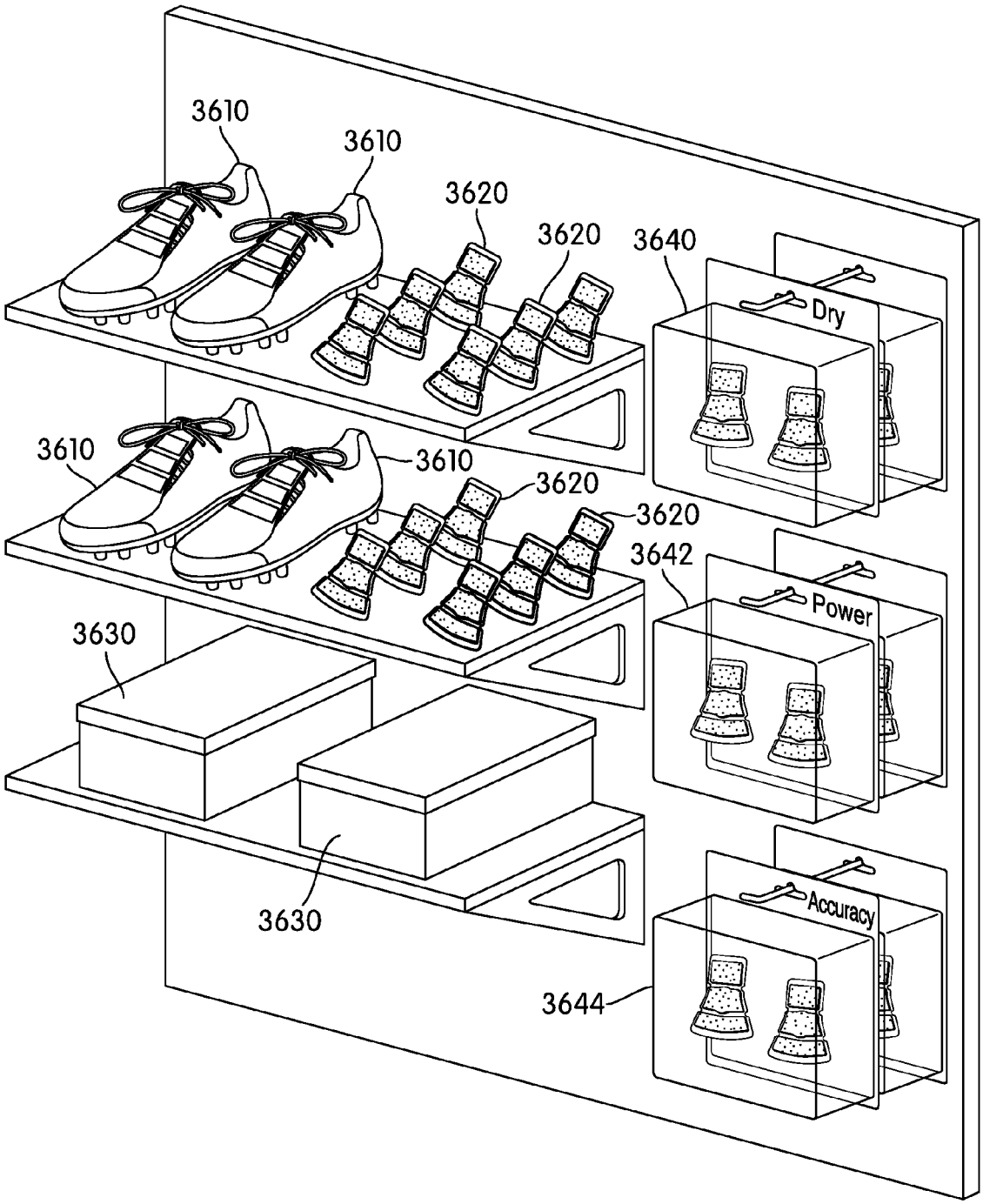
FIG. 25 is an illustration of a preferred embodiment of a retail system.

FIG. 25 is an illustration of a preferred embodiment of a retail system. Referring to FIG. 25, articles 3610 are sold simultaneously with inserts 3620. In this embodiment, the retail system is a wall section. In a preferred embodiment, this wall would be a portion of a sneaker section in a store. Articles 3610 and inserts 3620 are shown generically in FIG. 25 only for the purpose of illustration. In some embodiments, these inserts and articles can be different styles, colors, and arrangements of ball control elements.

In addition, in a preferred embodiment, articles 3610 can be prepackaged in boxes 3630. Boxes 3630 can contain a set of articles that are marked for shoe size, cleat or tread style, and footwear style, such as hightops or running shoes. Articles 3610 are illustrated as being sold in boxes 3630, however articles 3610 can be sold in any style, packaging, or manner desired.

Packages of inserts 3620 can be sold along side boxes 3630. FIG. 25 illustrates an example in which inserts 3620 are sold in plastic hanging packages. For example, inserts could be sold in packages, including dry use insert packages 3640, power use insert packages 3642, and accuracy use insert packages 3644. However, inserts 3620 can be sold in any arrangement or packaging desired. The retail wall system of FIG. 25 allows the user to easily purchase different article styles and their respective inserts.

Using a retail system, a user could select an article and select inserts from a group of candidate insert sets that have been prepackaged. By associating an insert of the selected insert candidate group with a selected article, the user has a modified article of footwear to provide varying degrees of fit, appearance, and ball control.

In some situations, it may be preferable for a user to purchase multiple pre-packaged insert sets at one time. Using a retail system, such as the embodiment illustrated in FIG. 25, a user could purchase two different articles 3610 and two different inserts 3620. This purchase would provide the user with four different variations in the type of article of footwear that could be obtained through the interchange of inserts 3620 and articles 3610 without the expense of paying for four different articles of footwear.

In addition, in another embodiment of the retail system, first insert 3510, second insert 3520, third insert 3530, or fourth insert 3540 (see FIG. 24) can be sold having different appearances. By selecting different inserts, the user may change the appearance of modified article 3570. For example, first insert 3510, second insert 3520, third insert 3530, and fourth insert 3540 can have different colors, patterns, logos, or customized appearances. Similarly, in some embodiments, articles may also be provided that have different appearances.

Generally, the various components used with an article of footwear including interchangeable inserts may be made of a variety of materials. A backing material for an insert may be made from any material known in the art associated with inserts, including, but not limited to, plastics, foams, natural and/or synthetic materials including leathers, as well as other materials. In some embodiments, the surface of the ball control element may be of a different material than the backing material. In some cases, the surface of the ball control element may be rubber or a similar material that is used to increase friction with opposing surfaces. In other embodiments, the backing material may be made of the same material as the surface of the ball control elements.

Additionally, the uppers and soles may be made of any material known in art for making uppers and soles. In particular, the outer tongue and the inner tongue could be made of various materials, including, but not limited to, rubber, plastic, leather, or any other appropriate material suitable for tongue construction in an article of footwear. In some cases, the outer tongue is made of a material with enough stiffness to receive the ball control elements in an interference fit. Additionally, as previously discussed, the inner tongue may include one or more mesh portions to increase breatheability of the article of footwear.

Accordingly, various embodiments of the present invention will help a user to control the interaction of an article of footwear with surfaces. A user can change inserts to change the surface interaction quality of the article. In addition, an article of footwear can be provided with a number of compatible inserts to change the fit, feel, appearance, and behavior of the article. Thus, the present invention provides an elegant solution by allowing an article of footwear to have many different qualities at a lower cost than purchasing separate articles of footwear.

While various embodiments of the invention have been described, it will be apparent to those of ordinary skill in the art that many more embodiments and implementations are possible that are within the scope of the invention.

What is claimed is:

1. An article of footwear comprising:

an insert;

a ball control element provided on the insert;

an upper configured to receive the insert;

an opening defined in the upper, the opening configured so that the ball control element protrudes through the opening when the insert is received by the upper;

an outer tongue provided on the upper;

an inner tongue provided between the outer tongue and an insole;

a first set of lacing sockets provided on the outer tongue; and a second set of lacing sockets provided on the inner tongue.

2. The article of footwear according to claim 1, wherein the opening is defined in the outer tongue provided on the upper.

3. The article of footwear according to claim 1, wherein the insert is received between the outer tongue and the inner tongue.

4. The article of footwear according to claim 1, wherein the inner tongue includes a mesh portion.

5. The article of footwear according to claim 1, wherein the inner tongue includes a reinforced portion.

6. The article of footwear according to claim 1, further comprising:

a lace that is threaded through the first and second sets of lacing sockets and that has a first end and a second end; and a first eyelet and a second eyelet defined in the upper, wherein the first end of the lace is associated with the first eyelet and the second end of the lace is associated with the second eyelet.

7. The article of footwear according to claim 1, wherein the outer tongue includes grip elements.

8. The article of footwear according to claim 1, wherein the ball control element is interference fitted into the opening with a portion of the ball control element hanging over a portion of the upper.

9. An article of footwear comprising:

an upper;

an outer tongue provided on the upper;

bridges provided on the outer tongue; and a removable insert to be received in the upper, the insert having ball control elements provided on a first surface of the insert, the ball control elements being configured to receive the bridges, wherein the insert is removable from the outer tongue and the upper.

10. The article of footwear according to claim 9, wherein the outer tongue has openings defined between the bridges to receive the ball control elements and wherein portions of the ball control elements cover portions of the bridges when the ball control elements are received by the openings.

11. The article of footwear according to claim 9, further comprising:

fastener strips provided on the insert; and fastener receiving strips provided on the upper to receive the fastener strips on the insert.

12. The article of footwear according to claim 11, wherein the fastener receiving strips are disposed on the outer tongue.

13. The article of footwear according to claim 12, wherein the fastener receiving strips are disposed on an inner tongue associated with the upper.

14. An article of footwear comprising:

an upper including an outer tongue and an inner tongue;

a removable insert including a backing that can be received between the outer tongue and the inner tongue provided in the upper;

a ball control element provided on the backing; and a lip provided on a portion of the ball control element, the lip being configured to engage a portion of the outer tongue, wherein the insert is removable from the outer tongue.

15. The article of footwear according to claim 14, wherein the lip is configured to hang over a portion of a bridge of the outer tongue so as to engage the bridge and secure the insert to the outer tongue.

16. The article of footwear according to claim 15, wherein the ball control element includes two or more lips, wherein each lip is configured to temporarily deform to allow the portion of the outer tongue past and to subsequently return to an original shape that hangs over the portion of the outer tongue to engage the portion of the outer tongue.

17. An article of footwear comprising:

a sole;

an upper attached to the sole;

a group of candidate inserts;

a plurality of ball control elements provided on each of the candidate inserts;

a plurality of openings provided in the upper to receive corresponding ball control elements; and wherein each insert of the group of inserts is configured to be received in the upper and wherein each insert of the group of inserts is manufactured to have a different type of ball control element.

18. The article of footwear according to claim 17, wherein the sole includes a cleat.

19. The article of footwear according to claim 17, wherein the group of inserts includes an insert having ball control elements configured with characteristics selected from the group consisting of accommodating wet conditions, increasing the power of kicking, increasing the accuracy of kicking, facilitating rock climbing, contacting a football, and contacting a soccer ball.

20. The article of footwear according to claim 17, wherein a pocket is provided in the upper, wherein the pocket is configured to receive any one of the group of candidate inserts.

21. The article of footwear according to claim 17, wherein the upper comprises an outer tongue and an inner tongue between which any one of the group of candidate inserts may be received.

22. The article of footwear according to claim 21, wherein the plurality of openings is disposed in the outer tongue.

23. The article of footwear according to claim 21, further comprising:

a first set of lacing sockets provided on the outer tongue; and a second set of lacing sockets provided on the inner tongue.

24. The article of footwear according to claim 23, further comprising:

a lace that is threaded through the first and second sets of lacing sockets and that has a first end and a second end; and a first eyelet and a second eyelet defined in the upper, wherein the first end of the lace is associated with the first eyelet and the second end of the lace is associated with the second eyelet.

25. The article of footwear according to claim 17, wherein each of the ball control elements is interference fitted into its corresponding opening with a portion of the ball control element hanging over a portion of the upper.

26. The article of footwear according to claim 17, wherein the upper includes a bridge between adjacent openings of the plurality of openings, wherein adjacent ball control elements of the plurality of ball control elements are received in the adjacent openings, and wherein portions of the adjacent ball control elements cover portions of the bridge when the adjacent ball control elements are received by the openings.

27. The article of footwear according to claim 17, wherein a ball control element of the plurality of ball control elements includes a lip configured to hang over a portion of the upper when the ball control element is received by its corresponding opening of the plurality of openings, so as to engage the portion of the upper.

* * * * *